United States Patent [19]

Van Zeeland

[11] 4,438,301

[45] Mar. 20, 1984

[54] MOVABLE MEMBER MEMBRANE SWITCH

[75] Inventor: Anthony J. Van Zeeland, Crystal Lake, Ill.

[73] Assignee: Oak Industries Inc., Rancho Bernardo, Calif.

[21] Appl. No.: 478,693

[22] Filed: Mar. 25, 1983

Related U.S. Application Data

[62] Division of Ser. No. 401,075, Jul. 23, 1982, Pat. No. 4,405,841.

[51] Int. Cl.[3] ..... H01H 15/00

[52] U.S. Cl. ..... 200/16 C; 200/16 D

[58] Field of Search ..... 200/16 C, 16 D

[56] References Cited

U.S. PATENT DOCUMENTS 3,352,980 11/1967 DuTemple De Rougement et al. ..... 200/16 D 3,485,966 12/1969 Bailey ..... 200/16 D 3,745,288 7/1973 Reimer ..... 200/16 D X 3,846,596 11/1974 Wolf ..... 200/16 D X 4,068,202 1/1978 Lyons, III ..... 200/16 D X

*Primary Examiner*—J. R. Scott

*Attorney, Agent, or Firm*—Kinzer, Plyer, Dorn & McEachran

[57] ABSTRACT

Membrane switch technology is applied to the more conventional switch construction found in a rotary switch and a slide switch. Specifically, there may be a membrane and a substrate, each having electrical contacts or contact means formed thereon. A spacer having openings or opening means is positioned between the membrane and the substrate. In the slide switch embodiment, a slide or movable member moves in the spacer opening with the slide forming either the connection between spaced contacts on the substrate or spaced contacts on the membrane and substrate.

3 Claims, 5 Drawing Figures

Fig. 1.
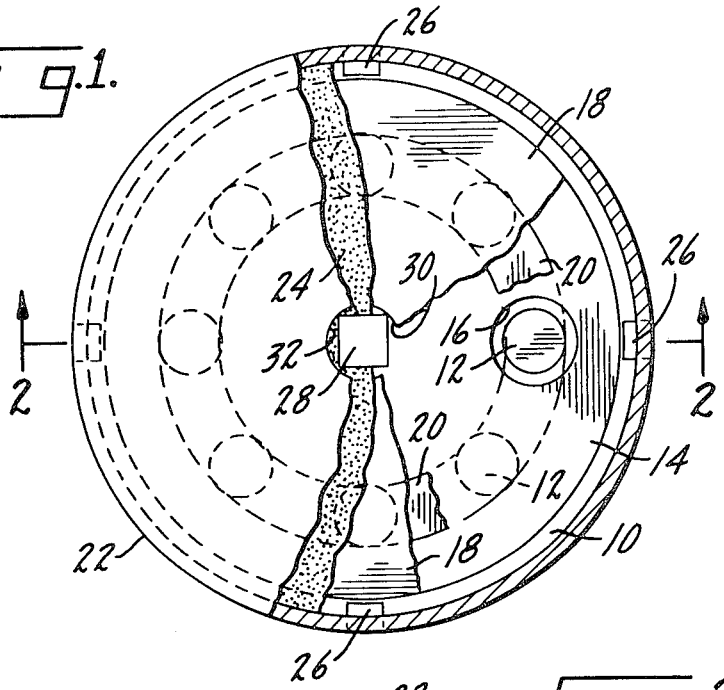
Fig. 2.
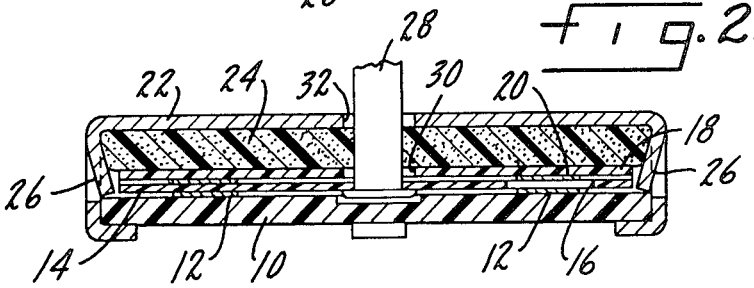
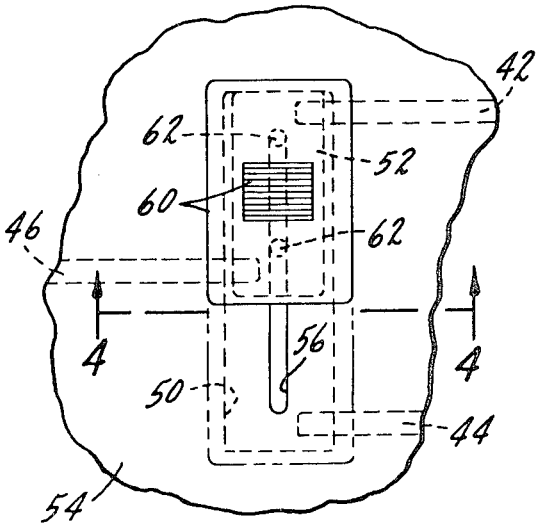
Fig. 3.
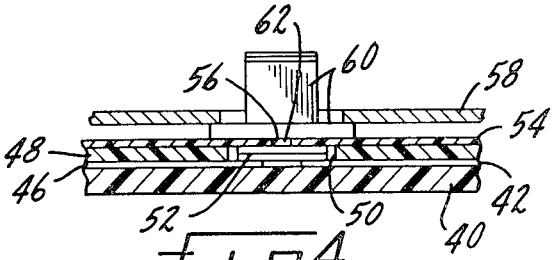
Fig. 4.
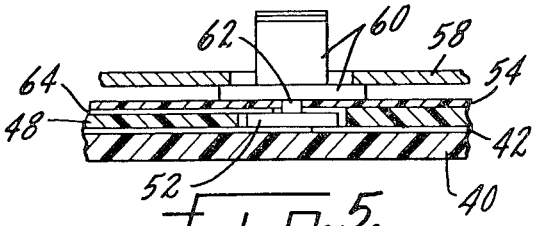
Fig. 5.

MOVABLE MEMBER MEMBRANE SWITCH

This is a division of application Ser. No. 401,075, filed July 23, 1982 now U.S. Pat. No. 4,405,841.

SUMMARY OF THE INVENTION

The present invention relates to mechanical switches and in particular to mechanical switches utilizing membrane switch technology.

One purpose of the invention is a rotary switch in which the members of the switch are formed from the materials and in the size and shape customarily utilized in membrane switch technology, specifically there being a membrane and substrate, spaced apart by a spacer with openings, with the spacer being movable to vary the position of the contacts available for a switch closure.

Another purpose is a slide switch utilizing membrane switch technology in which the spacer positioned between the substrate and the membrane has an elongated opening which accommodates a slide member movable between positions in which it either closes spaced contacts on the substrate or spaces contacts on the membrane and substrate.

Another purpose is a mechanical switch construction and design utilizing membrane switch technology therein.

Other purposes will appear in the ensuing specification, drawings and claims.

BRIEF DESCRIPTION OF THE DRAWINGS

The invention is illustrated diagrammatically in the following drawings wherein:

FIG. 1 is a top plan view, with portions broken away, illustrating a rotary switch of the type described, FIG. 2 is a section along plane 2—2 of FIG. 1, FIG. 3 is a top plan view of a slide switch of the type described, FIG. 4 is a section along plane 4—4 of FIG. 3, and FIG. 5 is a section, similar to FIG. 4, illustrating a modified form of slide switch.

DESCRIPTION OF THE PREFERRED EMBODIMENT

Membrane switch technology in its most customary form includes a three layer switch, with one or all of such layers being formed of a thin film of an insulative material such as Mylar or the like. Conventionally, there is a substrate which has electrical conductors formed thereon, for example by a silkscreen or printing process. The substrate faces an element called the membrane which may be formed of the same material as the substrate and which also will have electrical conductors formed thereon. Normally, the conductors on the membrane and substrate are formed in discrete, defined patterns which may be termed a switch array, with the patterns permitting a switch closure at defined locations in response to pressure at that location. The membrane and substrate are separated by a third element called the spacer, which also may be formed of Mylar or a similar insulative material and which has openings at designated locations, which locations form discrete switching areas. Normally, pressure applied to the membrane, for example by a finger or the like, or by a key, cause the membrane and its electrical contacts thereon to extend through the opening in the spacer and make a switch closure with similar contacts on the substrate. Such switches have found utility in hand held calculators, appliances and particularly in keyboards such as used in computer terminals, typewriters and the like.

The present invention adapts membrane switch technology to the more conventional mechanical switch such as a rotary switch or a slide switch.

In the FIGS. 1 and 2 construction, which illustrates a rotary switch, there is a substrate 10 which may be annular in form and which may have an annularly arranged group of individual round contacts formed thereon, indicated at 12. The contacts may be formed on the thin substrate by any one of a number of conventional processes such as printing with a conductive ink or a silkscreen process. Although not shown, there will be current paths in the form of thin conductive lines extending from each of the contacts 12 to a terminal point on the switch. As such conductive paths are conventional in membrane switch technology, they are not shown herein.

Positioned adjacent substrate 10 and its contacts 12 is a rotatable spacer member 14 which may have a single opening 16 formed thereon, which opening as particularly illustrated in FIG. 1, is in alignment or register with one of the contacts 12. Positioned on the opposite side of spacer 14 is a membrane 18 which will have an annular contact ring 20. Again, the ring 20 may have a connecting line to a terminal point, customarily called a tail in membrane switch technology.

A housing 22 encloses the switch formed of the substrate, spacer and membrane and is used to position a compressible member or a layer of compressible material such as foam rubber, indicated at 24 on top of the membrane. The housing may have in-turned tabs 26 at opposite sides thereof which are effective to maintain the position of the substrate relative to the remaining portions of the switch and also to position the compressible layer 24 so as to maintain an adequate and constant amount of pressure upon the membrane.

A shaft 28 is attached to spacer 14 and extends outwardly through openings 30 and 32 in the membrane and housing, respectively. The shaft may be rotatable by a suitable device and, when rotated, will move the position of spacer opening 16 from that shown to a position in register or in alignment with any one of the contacts 12 on the substrate. A suitable detent mechanism, common in rotary switches, may be utilized to insure that the rotatable spacer will only be positioned in alignment with substrate contact areas.

In the operation of a membrane switch it is necessary to apply pressure to the membrane to cause it to deflect through the spacer opening to close upon the substrate contacts. Such pressure is provided herein by the layer of compressible material. Thus, whenever the switch is at a position in which the spacer opening is located in alignment with a substrae contact, that particular position of the switch will be closed. The compressible layer 24 will always apply a sufficient pressure upon the membrane to provide a switch closure when the spacer is positioned at a detented switch position. Thus, rotation of the switch or rotation of the spacer will vary the position where there is a switch closure, as is conventional in a rotary type switch device.

In the embodiment of FIGS. 3 and 4, membrane switch technology is adapted to a slide switch. A substrate 40 may have three spaced contacts formed thereon, the contacts being indicated at 42, 44 and 46. Again, the contacts may be formed with a suitable conductive ink or the like. Positioned on top of substrate 40 is a spacer 48 having an elongated opening 50, particularly illustrated in FIG. 3. Movable in opening 50 is a slide member 52 which is movable between two positions. In the position shown in FIG. 3, slide member 52, which is metal or some other form of electrically conducting material, connects contacts 42 and 46. In the second position, when slide 52 has been moved downwardly, as illustrated in FIG. 3, it will connect contacts 44 and 46.

The membrane of the FIGS. 3 and 4 construction is illustrated at 54 and may have a small slot 56 formed therein, which slot is in alignment with, but substantially smaller than, opening 50 in the spacer. A housing or cover is indicated at 58 and supports a control member 60 thereon. The control member may have two downwardly-extending pins or projections 62 which will extend through slot 56 and into mating openings in slide member 52. Thus, movement of control member 60, through the described pinned connection, is effective to move slide member 52 back and forth between the two described positions whereby different contacts on the substrate are connected.

In the FIGS. 3 and 4 embodiment, the membrane functions more in the nature of a cover or protective device and does not have electrical contacts formed thereon. In the FIG. 5 embodiment, where like numbers have been given to like parts, the membrane has a contact thereon designated at 64. For example, the membrane contact may be positioned in the location of contact 46 on the substrate, whereby the slide may connect either substrate contact 42 and membrane contact 64 or substrate contact 44 and membrane contact 64. In like manner, the contact on the membrane may take the position of either of the substrate contacts. To continue, the contacts on either the membrane and/or substrate may take any pattern or shape or configuration, providing that they are so arranged relative to the slide member that movement of this member within the spacer slot is effective to change from one switch position to another.

Of advantage in the utilization of membrane switch technology in more conventional mechanical switch constructions is primarily cost, but, in addition, size. The materials forming a membrane switch, Mylar, conductive inks and the like, are relatively inexpensive and the manufacturing processes are subject to substantial automation. Because the switch members are quite thin, for example a few thousandths of an inch in thickness, the entire switch may be quite small and have a very low profile. This is very advantageous in many forms of modern electronic devices. Further, the same substrate, spacer and membrane members which form the mechanical switch, either rotary or slide, may have other portions thereof utilized in a more conventional membrane switch array. Thus, a portion of an entire switch panel may be operated by touch or by key, whereas, certain defined areas may include the more conventional rotary and slide switch constructions.

Whereas the preferred form of the invention has been shown and described herein, it should be realized that there may be many modifications, substitutions and alterations thereto.

The embodiments of the invention in which an exclusive property or privilege is claimed are defined as follows:

1. A slide switch using membrane technology including a substrate having spaced contacts thereon, a spacer positioned upon said substrate and contacts and having an opening therein which extends over an area in register with at least a portion of said spaced substrate contacts, a slide member positioned for movement in said spacer opening, a membrane positioned upon said spacer and having an opening therein in alignment with said spacer opening, a contact formed on the surface of said membrane facing said substrate and at least in part overlapping the opening in said spacer, said slide member being movable between positions to connect said membrane contact with one or more of said substrate contacts, and an operating member positioned upon said membrane and having means extending through said membrane opening into engagement with said slide member to cause operation thereof.

2. The slide switch of claim 1 further characterized in that there are three spaced contacts on said substrate, with said slide member being movable between a first position in which two of said contacts are connected thereby and a second position in which two different contacts are connected thereby.

3. The slide switch of claim 1 further characterized in that said membrane opening is substantially smaller than the opening in said spacer in which said slide member moves.

* * * * *